US009676456B2

(12) United States Patent
Sjølie Strand et al.

(10) Patent No.: US 9,676,456 B2
(45) Date of Patent: Jun. 13, 2017

(54) ARRANGEMENT FOR CONTAINMENT OF LIQUID NATURAL GAS (LNG)

(75) Inventors: Kjetil Sjølie Strand, Lier (NO); Jørn Magnus Jonas, Husøysund (NO); Andreas Norberg, Nøtterøy (NO)

(73) Assignee: LNG NEW TECHNOLOGIES PTE., LTD., Singapore (SG)

( * ) Notice: Subject to any disclaimer, the term of this patent is extended or adjusted under 35 U.S.C. 154(b) by 177 days.

(21) Appl. No.: 14/371,856

(22) PCT Filed: Jul. 24, 2012

(86) PCT No.: PCT/NO2012/050143
§ 371 (c)(1),
(2), (4) Date: Sep. 11, 2014

(87) PCT Pub. No.: WO2013/122475
PCT Pub. Date: Aug. 22, 2013

(65) Prior Publication Data

US 2014/0373770 A1 Dec. 25, 2014

(30) Foreign Application Priority Data

Feb. 17, 2012 (NO) ..... 20120167

(51) Int. Cl.
*B63B 35/00* (2006.01)
*B63B 25/16* (2006.01)
(Continued)

(52) U.S. Cl.
CPC ..... *B63B 35/00* (2013.01); *B63B 11/04* (2013.01); *B63B 25/12* (2013.01); *B63B 25/16* (2013.01);
(Continued)

(58) Field of Classification Search
CPC ..... F17C 2205/018; F17C 2270/0107; F17C 2270/0105; B63B 25/16
See application file for complete search history.

(56) References Cited

U.S. PATENT DOCUMENTS 3,067,713 A 12/1962 Meesen
3,490,639 A 1/1970 Gibson
(Continued)

FOREIGN PATENT DOCUMENTS

CN 1930416 3/2007
CN 1997850 7/2007
(Continued)

OTHER PUBLICATIONS

International Search Report issued May 23, 2013 in corresponding International Application No. PCT/NO2012/050143.
(Continued)

*Primary Examiner* — Edwin Swinehart
(74) *Attorney, Agent, or Firm* — Wenderoth, Lind & Ponack, L.L.P.

(57) ABSTRACT

The present invention relates to an arrangement for containment of liquid natural gas (LNG) in a hull compartment of a marine construction, comprising a self-supporting primary barrier, a second barrier surrounding the self-supporting primary barrier, and an access space between the self-supporting primary barrier and the secondary barrier. The self-supporting primary barrier is a liquid-tight self-supporting LNG tank and is connected with the hull compartment by support devices penetrating the secondary barrier. The secondary barrier is a liquid-tight thermal insulation connected with the interior surface of the hull and is sealed to the support devices by a flexible liquid tight seal, so that the self-supporting primary barrier and the secondary barrier are separately connected with the hull compartment to prevent
(Continued)

transfer of forces between the primary barrier and the second barrier.

14 Claims, 2 Drawing Sheets

(51) Int. Cl.
*B63B 11/04* (2006.01)
*B63B 25/12* (2006.01)

(52) U.S. Cl.
CPC *F17C 2201/0157* (2013.01); *F17C 2201/052* (2013.01); *F17C 2203/0631* (2013.01); *F17C 2221/033* (2013.01); *F17C 2223/0161* (2013.01); *F17C 2223/033* (2013.01); *F17C 2270/0107* (2013.01)

(56) References Cited

U.S. PATENT DOCUMENTS

| | | | |
|---|---|---|---|
| 3,605,425 | A | 9/1971 | Cuneo et al. |
| 3,659,543 | A | 5/1972 | Basile et al. |
| 3,692,205 | A | 9/1972 | Cowles et al. |
| 3,767,150 | A | 10/1973 | Tabata |
| 3,830,396 | A | 8/1974 | Jackson |
| 3,974,935 | A | 8/1976 | Ffooks |
| 4,066,184 | A | 1/1978 | Cuthbert et al. |
| 4,170,952 | A | 10/1979 | McCown |
| 2007/0228045 | A1 | 10/2007 | Goldbach et al. |
| 2007/0246473 | A1 | 10/2007 | Yang et al. |
| 2009/0223974 | A1 | 9/2009 | Felius |

FOREIGN PATENT DOCUMENTS

| | | |
|---|---|---|
| EP | 2 583 021 | 7/2014 |
| FR | 2 042 934 | 2/1971 |
| FR | 2 093 568 | 1/1972 |
| FR | 2 358 337 | 2/1978 |
| FR | 2 659 619 | 9/1991 |
| GB | 1119211 | 7/1968 |
| GB | 1170842 | 11/1969 |
| GB | 1300730 | 12/1972 |
| GB | 2 158 214 | 11/1985 |
| JP | 38-9524 | 6/1938 |
| JP | 42-018151 | 10/1942 |
| JP | 42-18151 | 10/1967 |
| JP | 45-23777 | 8/1970 |
| JP | 47-8338 | 5/1972 |
| JP | 52-121811 | 10/1977 |
| JP | 60-234199 | 11/1985 |
| JP | 8-99689 | 4/1996 |
| NL | 7001813 | 8/1970 |
| WO | 2005/093315 | 10/2005 |
| WO | 2006/003192 | 1/2006 |
| WO | 2011/157915 | 12/2011 |

OTHER PUBLICATIONS

International Preliminary Report on Patentability issued May 15, 2014 in corresponding International Application No. PCT/NO2012/050143.

Norwegian Search Report issued Apr. 20, 2012 in corresponding Norwegian Application No. 20120167.

Singapore Office Action issued Jun. 9, 2015 in corresponding Patent Application No. 11201404693Q.

Chinese Search Report issued Jul. 24, 2012 in corresponding Chinese Application No. 201280069950.9.

Chinese Office Action issued Jan. 25, 2016 in corresponding Chinese Application No. 201280069950.9 (with English translation).

Supplementary European Search Report issued Oct. 21, 2015 in corresponding European Application No. 12868372.

English translation of the Russian Office Action in corresponding Russian Application No. 2014127290.

English translation of Japanese Office Action issued Apr. 26, 2016 in corresponding Japanese Application No. 2014-557592.

ARRANGEMENT FOR CONTAINMENT OF LIQUID NATURAL GAS (LNG)

TECHNICAL FIELD

The present invention relates to an arrangement for containment of liquid natural gas (LNG) in a hull compartment of a marine construction, such as a ship, comprising a self-supporting primary barrier, a secondary barrier surrounding the self-supporting primary barrier, and an access space between the self-supporting primary barrier and the secondary barrier.

All related containments mentioned herein are for liquid gases. Common for all liquid gases related to this invention, including LNG, is that they are stored at temperatures significantly below ambient temperatures.

BACKGROUND OF THE INVENTION

A marine LNG containment system is a liquid tight compartment with thermal insulation. The LNG is kept very cold in the compartment and the purpose of thermal insulation is to insulate the LNG from influx of heat and to protect the hull construction of the LNG ship from the very low temperature of LNG.

Marine LNG containment systems are categorized by the International Maritime Organization (IMO) in the International Code for the Construction and Equipment of Ships Carrying Liquefied Gases in Bulk, normally known as the IGC Code. The IGC code categorizes present LNG cargo containment systems as membrane and independent tank types A, B and C.

Membrane LNG containment systems are based on a thin LNG barrier (primary barrier) and a collecting barrier (secondary barrier) outside the LNG barrier. Both barriers are supported through thermal insulation to the adjacent ship hull structure. Such LNG containment is not self-supporting in that the ship hull forms the load bearing structure. Membrane LNG containment systems are provided with a secondary barrier to ensure the integrity of the total system in the event of a primary barrier leakage.

Independent tank types A, B and C for liquid gases are completely self-supporting primary barriers which do not form part of the ship hull structure. With self-supporting it is meant that the load from the liquid gas inside the tank is taken up by the tank structure and plating and that the tank is transferring loads to the hull structure through supports.

An IMO independent tank type A is a tank which is designed primarily using classical ship-structural analysis procedure. If the cargo temperature at atmospheric pressure is below −10° C., a complete secondary barrier around a type A tank is required. The secondary barrier is constructed to withstand full collapse of the primary barrier.

IMO independent tank type A has traditionally been used on ships for liquid petroleum gases, also called LPG. The lowest temperature of LPG is −55° C., and on ships for LPG with IMO independent tank type A the hull compartment is made of low temperature steel to collect LPG in case of collapse of the tank (primary barrier). The hull structure is thus acting as the secondary barrier on ships for LPG with IMO independent tank type A. Ship hull acting as a secondary barrier for LNG is not allowed by the IGC Code due to the very low temperature of LNG.

Type B and C tanks are known tank types used for LNG on ships. They differ from Type A tanks in that type B and C tanks are constructed so that full collapse of the tank (primary barrier) shall not be possible, and consequently a full secondary barrier is not required.

Type B and type C LNG tanks are transferring loads to the hull structure through supports and the thermal insulation is attached to the tank (primary barrier). This is similar to Type A tanks for LPG.

The company Conch LNG pioneered the concept of bulk transport of LNG, and

LNG containment systems. The Conch concepts were based on a LNG primary barrier placed on load bearing thermal insulation. The Conch design is presently not used as LNG containment.

In the Conch design, such as described in U.S. Pat. No. 3,974,935 (Conch), the primary LNG tank is supported on spaced apart wooden bearer members (e.g. balsa wood) which are part of the outer insulation. The insulation layer supporting the bottom of the tank including bearer members of load bearing material is in direct contact with the primary barrier and supporting the loaded weight of the tank. Forces are transferred directly from the primary barrier to the secondary barrier, and an impact on the primary barrier may be directly transferred to the secondary barrier, and vice versa.

The present invention differs from the Conch patent in that in the present invention the self-supporting primary barrier and the secondary barrier are separately connected with the hull compartment to prevent transfer of forces between the primary barrier and the secondary barrier.

The present invention also differs from the Conch patent in that in the present invention there is an access space on all sides (above, below and on all sides) between the primary and secondary barrier.

The present invention differs from membrane LNG containments in that in membrane containments the primary barrier is not a rigid self-supporting tank, but a thin membrane that transfers the loads from the LNG, through both the primary and secondary barriers and to the hull structure.

The present invention differs from IMO type B and IMO type C LNG containments in that the present invention has a complete secondary barrier. The present invention differs from IMO type B and IMO type C containments in that in the present invention the LNG tank, defined as primary barrier in the IGC Code, and the thermal insulation, defined as secondary barrier in the IGC Code, have no direct structural connection and do not transfer any loads directly between them. An impact force on one of the barriers will not be transferred to the other barrier, while on type B and C tanks the thermal insulation is attached directly to the tank. The present invention differs from present IMO type A containment for liquefied gas in that on the present IMO type A containments for LPG the supports for the primary barrier are transferring loads to the adjacent secondary barrier structure. The present invention is an arrangement for containment of LNG where the supports for the primary barrier are transferring loads to adjacent structure so arranged that load transfer to secondary barrier is prevented.

SUMMARY OF THE INVENTION

The present invention relates to an arrangement for containment of liquid natural gas (LNG) in a hull compartment of a marine construction, comprising a self-supporting primary barrier, a secondary barrier surrounding the self-supporting primary barrier, and an access space between the self-supporting primary barrier and the secondary barrier. It is characterized in that the self-supporting primary barrier is a liquid-tight self-supporting LNG tank and is connected with the hull compartment by support devices penetrating the secondary barrier. The secondary barrier is a liquid-tight thermal insulation connected with the interior surface of the hull compartment and is sealed to the support devices by a flexible liquid tight seal, so that the self-supporting primary barrier and the secondary barrier are separately connected with the hull compartment to prevent transfer of forces between the primary barrier and the secondary barrier.

In an embodiment of the above arrangement, the secondary barrier is connected with the hull compartment plating by connection devices.

In a further embodiment of the above arrangement for containment, the secondary barrier is sprayed onto the interior surface of the hull compartment.

In a further embodiment of the above arrangement for containment, the support devices for the self-supporting primary barrier are located at the hull structure girders.

In a further embodiment of the above arrangement for containment, the liquid-tight self-supporting LNG tank is an IMO independent tank type A.

In a further embodiment of the above arrangement for containment, the marine construction is a ship.

In a further embodiment of the above arrangement for containment, the marine construction is a barge or other floating unit.

DETAILED DESCRIPTION OF THE INVENTION

Figure 1:
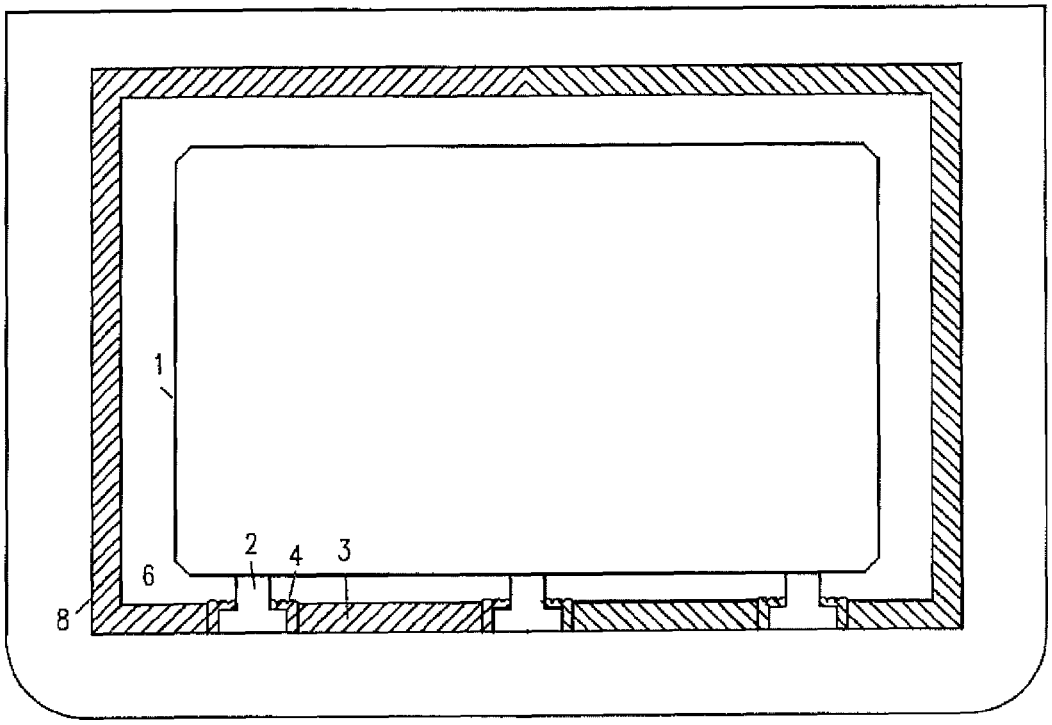
FIG. 1 shows an arrangement according to the present invention for containment of liquid natural gas (LNG) in a hull compartment of a marine construction.

FIG. 1 shows an arrangement according to the present invention for containment of liquid natural gas (LNG) in a hull compartment 8 of a marine construction, comprising a liquid-tight self-supporting LNG tank primary barrier 1, a liquid-tight thermal insulation secondary barrier 3 which is surrounding the primary barrier 1, and an access space 6 between the primary barrier 1 and the secondary barrier 3. The liquid-tight self-supporting LNG tank primary barrier 1 is connected with the hull compartment 8 by support devices 2 penetrating the secondary barrier 3. The liquid-tight thermal insulation secondary barrier 3 is connected with the interior surface of the hull compartment 8 and is sealed to the support devices 2 by a flexible liquid tight seal 4.

Figure 2:
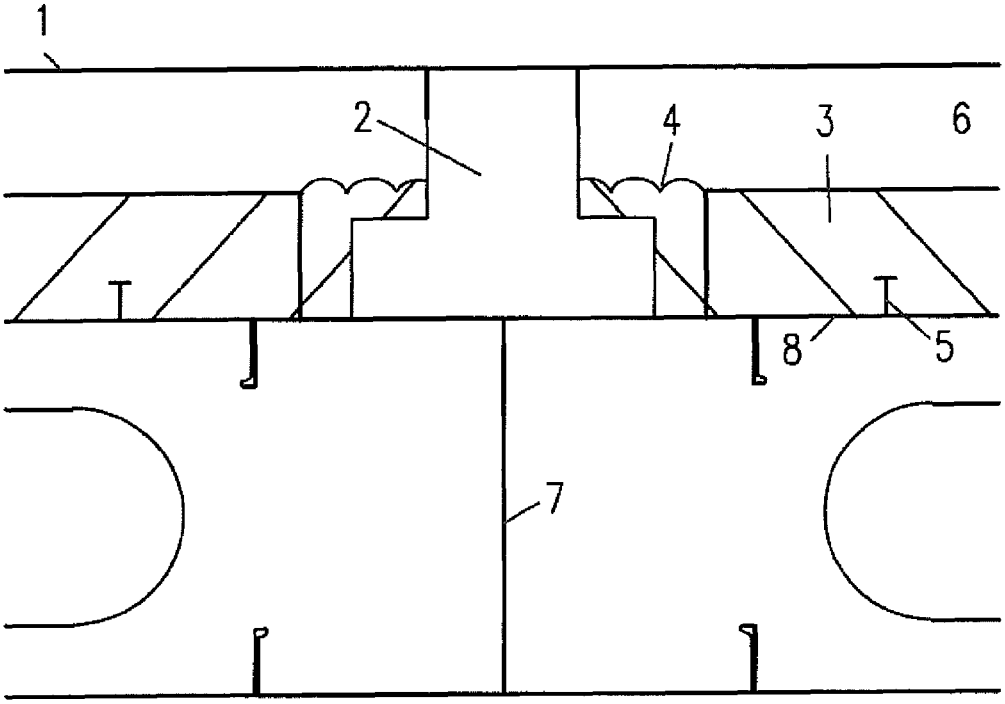
FIG. 2 shows details regarding a support device for a self-supporting LNG tank primary barrier.

In FIG. 2, the liquid-tight self-supporting LNG tank primary barrier 1, the support device 2, the liquid-tight thermal insulation secondary barrier 3, the flexible liquid tight seal 4, the access space 6 and the hull compartment 8 are shown in greater detail. Further, FIG. 2 shows hull structure girders 7, and connection devices 5 for connecting the secondary barrier 3 with the hull compartment plating.

The marine construction is preferably a ship. The marine construction may also be other marine construction such as a barge or other floating unit.

The present invention is an arrangement for containment of liquid natural gas (LNG) in ships and other marine constructions for LNG storage and transportation. It comprises a self-supporting independent LNG tank as primary barrier 1 with support devices 2 inside a hull compartment 8, a secondary barrier 3 which is connected 5 to the hull compartment 8, and an access space 6 between the barriers and the support devices 2. The primary barrier and the secondary barrier are arranged independently from each other in that forces are prevented from transfer between the two barriers.

The LNG primary barrier 1 is a rigid self-supporting tank, preferably an IMO independent tank type A, that is constructed to contain LNG. The tank is kept in place in a ship or marine construction compartment by tank support devices 2. The tank support devices 2 are fixed to the hull structure and transfer loads to girders 7 in the hull structure. The tank support devices 2 are typically made of hard wood or other thermal insulating support materials. The support devices have a sliding surface to the primary barrier to allow for thermal contraction and expansion of the primary barrier. Certain support devices in the longitudinal centerline and a transverse cross-section of the tank are fixed in the transverse and longitudinal directions respectively in order to keep the tank in position. This is a known method used for marine liquid gas tanks.

The LNG secondary barrier 3 is thermal insulation with liquid tight surface that is connected to the hull compartment surface plating 8. The secondary barrier is constructed to withstand LNG leakage from the LNG tank primary barrier 1 so that a ship's hull compartment and structure is not exposed to the very cold LNG. The insulation surfaces are as such forming a liquid tight thermal insulation layer on the ship's hull compartment interior surfaces, outside the LNG primary barrier.

The insulation arrangement is constructed as a complete thermal and liquid barrier between the LNG primary barrier and the ship compartment surfaces, and is directly connected to the hull compartment 8 by a suitable connection method such as connection devices 5. The insulation surfaces are crimping on the cold side in relation to the warm side when LNG is filled in to the tank. The liquid tight thermal insulation arrangement is preferably connected to the hull compartment plating with stud bolts and so constructed that there are means for thermal movement between the stud bolts.

The present invention is an arrangement for containment of LNG comprising an independent rigid inner LNG tank primary barrier 1 and an outer insulation arrangement which is constructed to be a secondary barrier 3. The insulation is liquid tight and will during normal operation and during possible LNG leak have LNG temperature on inner side and have close to ambient temperature on the outers sides. Where the primary barrier support devices 2 to the hull structure are penetrating the thermal insulation with secondary barrier 3 the interface between the support devices 2 and the secondary barrier 3 is made by a flexible and liquid tight seal 4. The seal 4 is made as an un-interrupted sleeve around the support devices 2. The interaction between the secondary barrier 3 and the support devices 2 is so that transfer of forces between the barriers is prevented. The flexible liquid tight seal 4 being part of the secondary barrier 3 is fastened to the support devices 2 preferably by glue adhesion with possible additional mechanical fastening.

The support devices 2 between the primary barrier 1 and the hull structure have a flexible interaction to the liquid tight seal 4 so that an impact on the primary LNG barrier 1 will not damage the LNG secondary barrier 3.

The secondary barrier 3 with insulation is connected to the hull compartment 8 by stud bolts or similar devices 5 independent from the primary barrier, so that an impact on the secondary barrier 3 will not be directly transferred to the primary barrier 1.

The invention is an arrangement of two independent barriers within the same hull compartment for the containment of LNG. The primary barrier 1 is transferring loads to the hull structure's girders 7 through the support devices 2. The secondary barrier 3 is connected to the hull compartment surface plating 8 through stud bolts or similar devices 5. The interaction between the support devices 2 and the secondary barrier 3 is by a flexible liquid tight seal 4 ensuring that forces are prevented from being transferred directly from one barrier to the other. In the present invention the secondary barrier is, in case of primary barrier collapse, transferring loads from LNG to the adjacent hold space structure. A secondary barrier collapse is likely to happen in case the hull compartment plating is collapsing, e.g. in case of ship collision or ship grounding. The LNG tank (primary barrier) is free standing on the hull structure and is only in sliding contact with the support devices. A collapse of the hull compartment plating is not likely to cause collapse of the LNG primary barrier.

Supports and connections between each individual LNG barrier and the hull structure are so arranged that where the support devices between the LNG tank and the hull structure is penetrating the secondary barrier the interaction is made by a flexible and liquid tight seal. An impact force and possible damage will not be directly transferred from one barrier to the other.

LNG containment primary barrier 1 and secondary barrier 3 are arranged with a distance between the barriers so that access, for personnel and/or equipment, for inspection and repair of both barriers is possible in the access space 6. Access to the access space 6 may be arranged in different ways. For example, the access space 6 may be accessed through an existing access arrangement, or by cutting a hole into the access space 6.

The invention claimed is:

1. Arrangement for containment of liquid natural gas (LNG) in a hull compartment of a marine construction, comprising a self-supporting primary barrier, a secondary barrier surrounding the self-supporting primary barrier, and an access space between the self-supporting primary barrier and the secondary barrier, wherein the self-supporting primary barrier is a liquid-tight self-supporting LNG tank and is connected with the hull compartment by support devices penetrating the secondary barrier, the secondary barrier is a liquid-tight thermal insulation connected with an interior surface of the hull compartment and is sealed to the support devices by a flexible liquid tight seal made as an un-interrupted sleeve around the support devices, so that the self-supporting primary barrier and the secondary barrier are separately connected with the hull compartment and transfer of forces between the primary barrier and the secondary barrier is prevented by the flexible liquid tight seal.

2. Arrangement for containment according to claim 1, wherein the secondary barrier is connected with the hull compartment plating by connection devices.

3. Arrangement for containment according to claim 1, wherein the secondary barrier is sprayed onto the interior surface of the hull compartment.

4. Arrangement for containment according to claim 1, wherein the support devices for the self-supporting primary barrier are located at hull structure girders.

5. Arrangement for containment according to claim 1, wherein the marine construction is a ship.

6. Arrangement for containment according to claim 1, wherein the marine construction is a barge or other floating unit.

7. Arrangement for containment according to claim 2, wherein the secondary barrier is sprayed onto the interior surface of the hull compartment.

8. Arrangement for containment according to claim 2, wherein the support devices for the self-supporting primary barrier are located at hull structure girders.

9. Arrangement for containment according to claim 3, wherein the support devices for the self-supporting primary barrier are located at hull structure girders.

10. Arrangement for containment according to claim 7, wherein the support devices for the self-supporting primary barrier are located at hull structure girders.

11. Arrangement for containment according to claim 2, wherein the marine construction is a ship.

12. Arrangement for containment according to claim 3, wherein the marine construction is a ship.

13. Arrangement for containment according to claim 1, wherein the liquid gas is liquid natural gas (LNG).

14. Arrangement for containment according to claim 1, wherein the liquid-tight self-supporting liquid gas tank is a liquid-tight self-supporting liquid natural gas (LNG) tank.

* * * * *